US005772345A

United States Patent [19]

Simonds

[11] Patent Number: 5,772,345

[45] Date of Patent: Jun. 30, 1998

[54] SHIELDED WRITING SYSTEM

[76] Inventor: James A. Simonds, 3335 Scrub Oak Dr., Santa Rosa, Calif. 95404

[21] Appl. No.: 466,837

[22] Filed: Jun. 2, 1995

[51] Int. Cl.[6] ..... B43K 29/00

[52] U.S. Cl. ..... 401/48; 211/69.5; 248/118.5; 401/6; 401/88; 401/131

[58] Field of Search ..... 401/48, 88, 6, 401/131; 248/118.5; 211/69.5, 69.6, 69.7

[56] References Cited

U.S. PATENT DOCUMENTS

| | | | |
|---|---|---|---|
| 1,641,829 | 9/1927 | Sheaffer et al. | 211/69.5 |
| 1,857,460 | 5/1932 | La Chance | 211/69.5 |
| 1,892,509 | 12/1932 | Guyot | 211/69.7 |
| 2,870,740 | 1/1959 | Vogt | 401/88 |
| 3,250,255 | 5/1966 | Cruickshank | 248/118.5 |
| 4,313,585 | 2/1982 | Bricker | 401/48 X |
| 4,341,300 | 7/1982 | Roy | 211/69.5 X |
| 4,602,885 | 7/1986 | Bischoff et al. | 401/48 X |
| 4,917,517 | 4/1990 | Ertz | 401/48 X |

FOREIGN PATENT DOCUMENTS

| | | | |
|---|---|---|---|
| 505473 | 7/1920 | France | 401/48 |
| 529446 | 6/1955 | Italy | 211/69.5 |

*Primary Examiner*—Steven A. Bratlie
*Attorney, Agent, or Firm*—Corwin R. Horton

[57] ABSTRACT

A shielded writing system includes a hand shield and a shielded writing instrument. The hand shield comprises a thin plate having a pillar projecting from one side thereof and appropriately contoured to be grasped by the two free fingers of writing hand. The plate extends outwardly in all directions from the connection therewith of the pillar to fully underlie the butt of the hand (held in a loose fist of the writing position) as a barrier to contact with the writing surface. In the direction from the pillar that the thumb and forefinger are to project, the plate terminates short of the tips of the thumb and forefinger. The pillar has a cavity to serve as a receptacle for a writing instrument. A tubular shield of resilient material is provided into which a writing instrument is inserted to protect the user from cross-contamination with the instrument. The tubular shield is longitudinally slit, and open at either end to permit the instrument to extend therethrough.

19 Claims, 2 Drawing Sheets

SHIELDED WRITING SYSTEM

BACKGROUND OF THE INVENTION

This invention relates to a writing system for maintaining cleanliness in writing by hand, particularly in environments where the writer's hand, the writing instrument and/or the paper or other writing surface may be soiled or subjected to infectious organisms. In an industrial working environment, the writer, such as an auto mechanic with soiled hands, may need to make notes and will wish to avoid soiling the paper.

Similarly, in the health care environment it highly important to maintain aseptic conditions. Medical or dental operators, typically gloved, frequently will need to take notes or make data entries on paper or the like during an operation and need to avoid picking up contamination on their gloves, from either the paper or the pen, which could be transferred to the patient. Conversely, they wish to avoid transferring to the paper any biological or other contamination on their hands, which could lead to spreading of infection. The operator may double glove and remove the outer gloves each time an entry is made. However this is time-consuming and cumbersome and creates waste, because the outer gloves can be used only one time. "Aseptic" pens are available, which can be autoclaved to preserve sterility. However, such pens are expensive and require frequent sterilizing. Moreover, cross-contamination with the paper will still occur, though direct contact between the writing hand and the paper.

To avoid pick-up of ink or other writing fluid on the hand, protective cuffs have been employed. The cuff is secured to the wrist or hand and cover the butt of the hand that comes into contact with the writing surface. Among other limitations, they are clumsy and inconvenient, particularly as they are time consuming to apply and remove for each use.

In an attempt to avoid cross-contamination, shield plates have been employed that are adapted to rest on the writing surface below the butt of the hand and to slide across the writing surface with the hand as it writes. The underside of the shield is provided with several short spaced-apart projections serving as support legs to lift the plate above the paper surface. The support legs lower the frictional contact area with the writing surface so that the hand contact on the upper side of the disk is sufficient to cause the plate to slide over the writing surface with the hand as it writes. This device, because it must be elevated, consequently elevates the hand to an unnatural writing position. Because the device is mounted on legs, the shield plate must be able resist bending forces. It is consequently relatively thick and heavy and thus less wieldable. To move the device from the writing surface to another, the user must pick it up and hold it at the side margins, which will most likely bring the fingers into contact with writing surfaces, causing cross-contamination. Additionally, due to the low and flat configuration of this device, it is not conducive to providing thereon of effective means for supporting the writing instrument when it is not in use.

Consequently, there is a need for shielded writing system which provides a hand shield that is light and wieldable and easy to use without compromising the normal writing posture, which may be conveniently lifted from one surface and placed on another without risk of cross-contamination, which may be transparent and made cheaply enough to be disposable and which is conveniently provided with means for holding the writing instrument when not in use. There is, further, a need for a shielded pen which may of constructed simply and cheaply, and thus made disposable, to permit the use of an ordinary pen in the writing system, without cross-contamination.

SUMMARY OF THE INVENTION

By this invention a shielded writing system is provided which includes a hand shield comprising a thin plate having a pillar projecting from one side thereof. The pillar is grasped by the two free fingers of the pen hand (the little and adjacent finger), leaving the thumb, forefinger and next adjacent finger free to grasp and manipulate the writing instrument. The pillar is appropriately contoured and projects from the plate at angle for ease of holding by the free fingers while the pen is held in the writing position by the other fingers and thumb. The plate extends outwardly in the plane of the plate in all directions from the connection therewith of the pillar, desirably a sufficient distance to fully underlie the butt of the hand (held in a loose fist of the writing position) so that it will provide a full barrier between the hand and paper to prevent contact therebetween. In the direction from the pillar that the thumb and forefinger are to project, the plate desirably terminates short of the tips of the thumb and forefinger so that the writing instrument can extend downwardly beyond the margin of plate to the paper surface unimpeded by the plate. The bottom side of the plate is planar and smooth so that it slides easily over the writing surface and is free of projections or feet so that it rests immediately on the writing surface with minimum elevation of the hand above its normal writing position.

In another aspect of this invention for ease of grasping and manipulating the shield, the side or margin of the pillar in the direction the thumb and forefinger project is advantageously canted in that direction from the perpendicular to the plate at an angle desirably from about 5 to 45 degrees and preferably 10 to 40 degrees and is shaped to have sides which extend generally in the direction of thumb and forefinger projection and desirably also having a longitudinal axis, in a plane parallel to the plate, that extends in the direction of the thumb and forefinger projection.

In yet another aspect of this invention the pillar of the hand shield contains a cavity or hole at its end distant from the plate and extending toward the plate to serve as a receptacle for a writing end of a writing instrument. The pillar writing instrument receptacle is conveniently used to hold the writing instrument while it is not in use thus avoiding its undesired contact with other surfaces.

In another feature of the shielded writing system of this invention a tubular shield is provided into which a writing instrument may inserted to protect the user from cross-contamination with the instrument. The tubular shield is open at either end to permit the instrument to extend therethrough. The shield is made of somewhat resilient material and is longitudinally slit to accommodate and hold writing instruments of various diameters. Advantageously, toward the end of the tubular shield to be distant from the writing end of the instrument the margins of the slit are flared outwardly so as to better accommodate and protect a writing instrument having a pocket clip.

DETAILED DESCRIPTION OF THE PREFERRED EMBODIMENT

The following description illustrates the manner in which the principles of the invention are applied but is not to be construed as limiting the scope of the invention.

Figure 1:
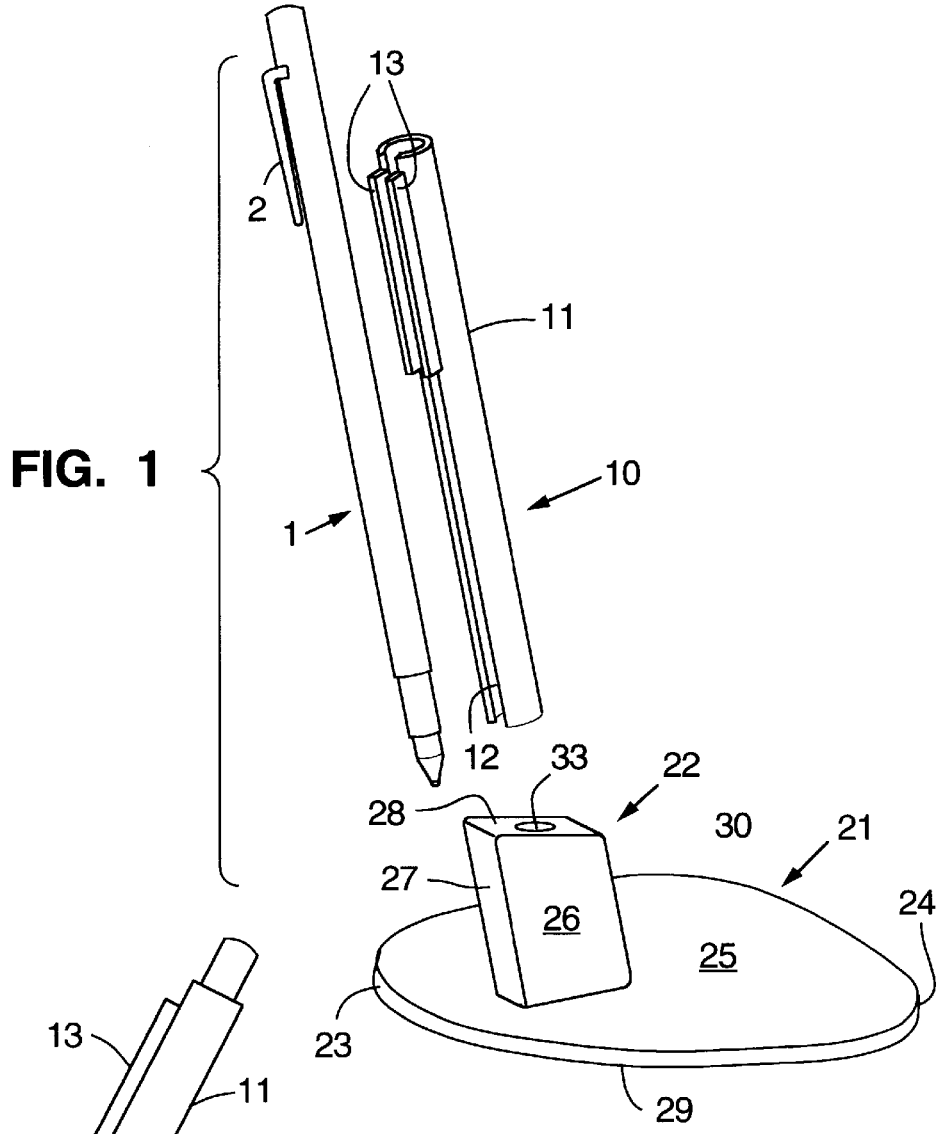
FIG. 1 is an isometric view of an embodiment a writing shield system of this invention with the hand shield spaced from the pen and pen shield and the pen removed from the pen shield.
Figure 5:
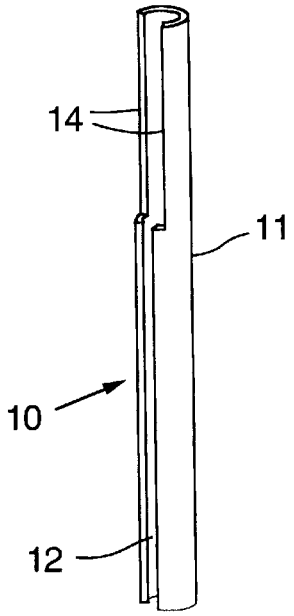
FIG. 5 is an isometric view of another embodiment of the pen shield of this invention.

Referring first to FIG. 1, the shielded writing system of this invention generally comprises a writing instrument such as pen 1, a tubular pen shield 10 and a hand shield 20. Pen shield 10 comprises a tube 11 having an internal diameter approximately the same as the external diameter of pen 1 so that pen 1 may be conveniently received in tube 11 and held in place by the user gripping tube 11. Tube 11 is slit along its length at longitudinal slit 12 so that tube 11 is capable of expanding or contracting to some extent in order to accommodate pens of various diameters. Tube 11 is desirably at least about 4 inches in length and preferably between 4 to 6 inches long, in order to fully shield the pen from the hand grasping it in the writing position and yet be of a convenient length. Toward the end of shield 10 distant from the writing end of pen 1, margins of slit 12 are flared outwardly to provide flanges 13. Flanges 13 are desirable to accommodate and protect the pocket clip 2 of pen 1, as are often provided on writing instruments. Alternatively, as shown in FIG. 5, pocket clips may be accommodated by providing cut outs 14 at the margins of slit 12.

Figure 2:
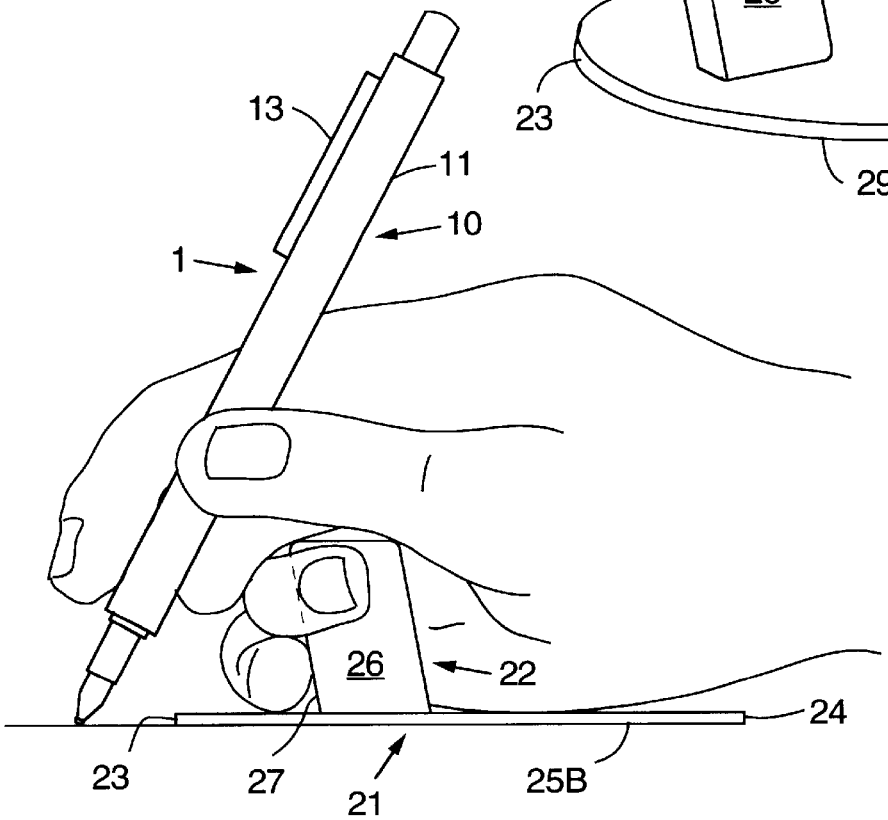
FIG. 2 is plan view of the embodiment a of writing shield system of FIG. 1 shown in use grasped in the hand of the user.
Figure 3:
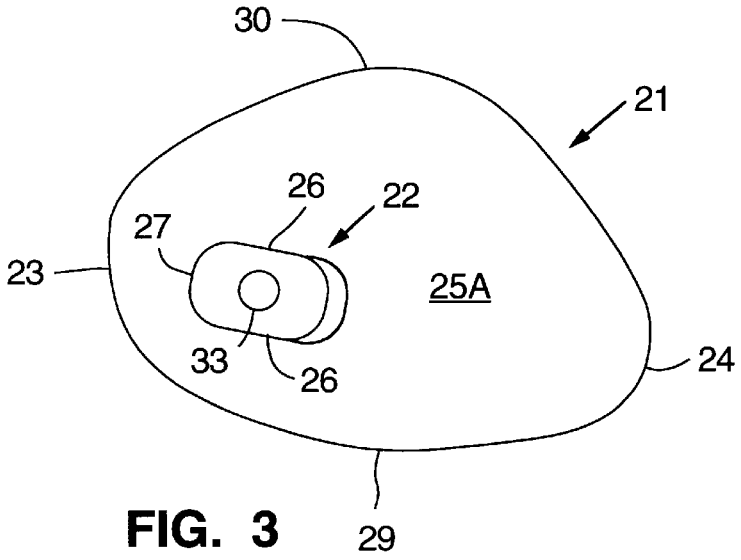
FIG. 3 is top view of the hand shield of FIG. 2 with the user's hand removed.

Hand shield 20 shown in FIGS. 1–3 comprises plate 21 and pillar 22. Plate 21 is flat and is configured to substantially cover the surface underlying the butt of the hand when the hand is in the writing position and resting (normally) on the writing surface. As seen in FIG. 2, this includes the side of the hand and the sides of the smallest and adjacent finger. As can also be seen in FIG. 2, the thumb and forefinger holding the writing instrument project generally forward from the hand to hold the writing instrument in a position forward of the butt of the hand. As shown in FIGS. 2 and 3, preferred conforming configuration is a generally "teardrop" shape with the larger end in the direction of projection of the thumb terminating at forward margin 23 of the periphery and the tail toward the wrist terminating at a rearward margin 24. The shape may also be more elliptical or even circular, particularly for embodiments useable with both the left and right hand, as will be explained.

Plate 21 is thin so that it is light weight, easily manipulated in the hand and capable of sliding easily over a flat surfaces such as paper. Desirably, plate 21 is has a thickness of ¼ inch or less and preferably 1 millimeter or less. Advantageously plate 21 is made of transparent plastic, such as acrylic polymer, so that when it is rested on a writing surface the indicia on that surface is not visually obstructed by the plate. Since plate 21 rests immediately on the writing surface and is supported thereby, it can be thin and flexible, thus increasing its ease of manipulation and sliding on the writing surface.

The underside 25B of the plate is flat and smooth so that it slides easily over the writing surface and is free of projections or feet so that it rests immediately on the writing surface. Thus, there is minimum elevation of the hand when resting thereon, above the hand's normal writing position on the writing surface. To further enhance its ability to slide easily on flat surfaces, plate 21 has a continuously curved periphery with the edges thereof desirably being curved or beveled.

Pillar 22 is attached to plate 21 at a location within the periphery thereof as will be discussed and extends generally upward from surface 25A thereof. Pillar 22 is secured to plate 21 against angular movement relative thereto during use.

Pillar 22 is advantageously configured to be held securely by the third and fourth fingers as they are normally positioned in the typical loose fist mode of most writers. Pillar 22 has a longitudinal axis in the plane parallel to upper plate surface 25A that extends generally in same direction as the thumb and forefinger will project when shield 20 is held by the hand in the writing position ("thumb direction"). Pillar 22 is may be round but desirably it ovular or rectangular (as shown) in the plane parallel with plate surface 25A, with sides 26 also extending generally in the thumb direction. Preferably pillar 22 is tapered in the thumb direction to best fit into the crook of the small and adjacent fingers closed upon it.

Pillar 22 extends upwardly from upper surface 25A to a height that will permit the fourth and fifth finger (little and next adjacent finger) of the writing hand to grasp and hold the pillar, with the butt of the hand {little finger side) resting against surface 25A, all as shown in FIG. 2. If the pillar 22 extends too high, the top 28 of pillar 22 may abut the palm and upper parts of the forefinger and second finger and maintain the butt of the above upper surface 25A, rather than resting against surface 25A. Thus the height of pillar 22 from surface 25A is desirably no greater than 2 inches and preferably less than 1 and ½ inches, in order to accommodate all but very small hands.

For ease of grasping by the little and/or adjacent finger, pillar 22 is not wider than 1 inch, and desirably is between ¼ and ¾ inch wide, in the direction transverse to the thumb direction. In the thumb direction, the pillar is desirably at least ½ inch wide and preferably from ¾ to 1 and ½ inches wide. In the preferred mode, as shown in the drawings, pillar 22 is substantially wider in the thumb direction so that longitudinal axis thereof, in the plane parallel to plate 21, is in the thumb direction. The outer perimeter and surface of pillar may be roughened or provided with projecting corners for easier holding.

To best fit in the free fingers in the writing position leading side or edge 26 of pillar 22 in the thumb direction is generally angled or canted forward from perpendicular with upper surface 25A in the thumb direction, desirably at an angle of between 5 to 45 degrees and preferably between 10 and 40 degrees.

While pillar 22 is the preferred embodiment, other types of handles or grasping means may be employed and secured to plate 21 appropriately to be graspable by the little and/or adjacent finger. For example a circular ring may instead be attached to surface 25A at the same location as pillar 22 with its opening transverse to the forward or thumb direction so that either or both the little and adjacent finer may be inserted therein to hold hand shield 21.

The most efficient plate configuration will differ for left-handed and right-handed users, since the pillar is located somewhat to one side of the center of the hand holding the hand shield while in writing position. Thus to fully cover the area underlying the hand, the margin of plate must extend transversely to the thumb direction farther outwardly in the palm direction than the direction toward the back of the hand, usually one and one half to twice the distance from the pillar. Thus, in the right-handed version shown in the drawings, the left margin 29 is substantially closer to pillar 22 than the right margin 30.

If desired, the plate may be extended in both directions transversely to the thumb direction a distance such that the entire hand area is covered when the shield is used in either the left or right hand. However, this design is unnecessarily wide for either hand and thus less wieldable so the specific left and right-handed configuration described is preferred.

Plate 21 extends in the thumb direction from pillar 22 a distance to fully underlie the fingers holding pillar 22, which is desirably at least about ¾ of an inch, but not so far in that direction as to underlie the normal position of the writing end of the pen as normally held by the user. To avoid interference by plate 21 with normal writing, the margin of plate 21 extends forward of pillar 22 no farther that 2 inches and desirably no more than 1 and ½ inches, toward margin 23. For full coverage of hand in the direction opposite to the thumb direction shield 21 will extend from pillar 22 two or three times farther, typically between 2 to 4 inches, toward the margin 24. For full coverage of the hand transverse to the thumb direction, plate 21 will extend in the palm direction between 2 and 4 inches and in the other direction extend from 1 to 2 inches. For a shield designed for use in either the right or left hand, shield 21 may extend an equal distance in the transverse direction of from 2 to 4 inches. In this design, the plate may be somewhat circular in shape.

Figure 6:
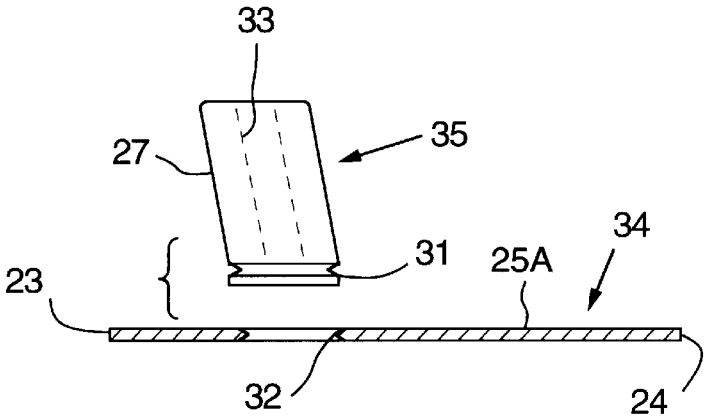
FIG. 6 is a plan view of another embodiment of the hand shield of this invention showing the pillar removed from the mounting socket therefor in the shield plate.

Pillar 22 may be molded unitarily with plate 21 or fastened to plate 21 in any other conventional manner. As shown in an alternative embodiment in FIG. 6, pillar 35 may be provided with means to mount it at either side of the plate. Specifically, an annular snap ring 31 may be provided at one end which will snap fit into a circular hole 32 provided in plate 34 to secure pillar 35 thereto. This embodiment has the advantage that pillar 35 can be secured to either side of plate 34 so that it may be converted from a left-handed to a right-handed configuration, or vice versa.

Figure 4:
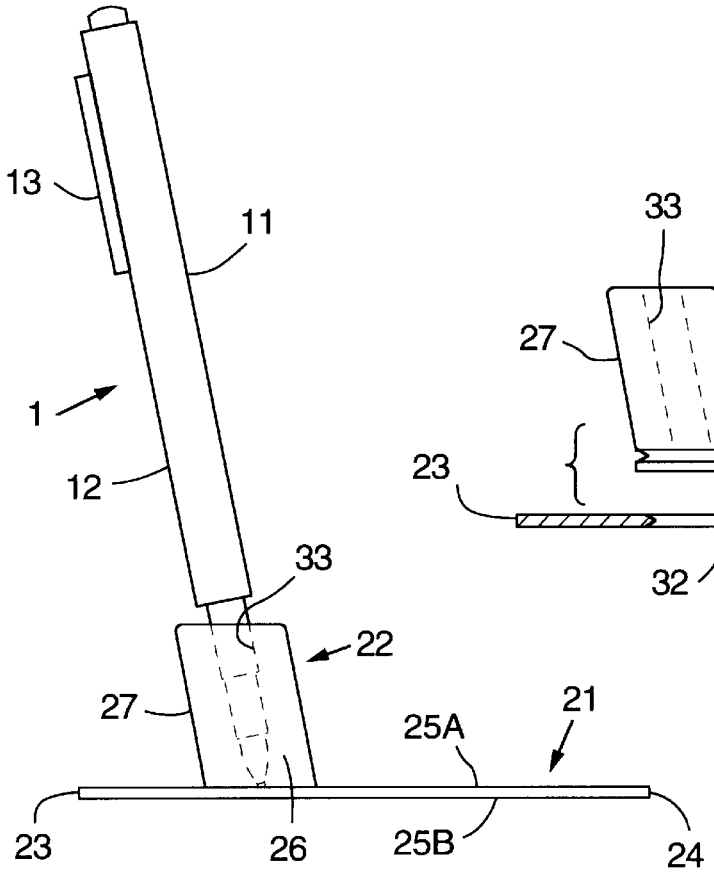
FIG. 4 is the plan view of the embodiment of the writing shield invention of FIG. 2 showing the pen shield engaged on the pen and the pen received in and supported by the pillar of the hand shield.

Referring to FIG. 4, cavity 33 extends downward into pillar 22 from its upper end to serve as a receptacle for writing end of pen 1, shown to be received and supported in pillar 22.

In using the shielded writing system, the operator first inserts a pen 1 or other writing instrument into the top end of pen shield 10 a distance far enough to have the writing end protrude from the bottom end. The shielded pen can then be inserted into cavity 33 of pillar 22 for storage in hand shield 20 ready for use. In preparation for use, hand shield 20 may be deposited on the paper or other writing surface for convenient availability when desired.

To write with this system, with the writing hand the operator will grasp pen 1 over the pen shield 10 and remove it from the hand shield 20. The operator then grasps pillar 22 with the little and adjacent finger of the writing hand to hold hand shield 20 in the shielding position. Then, the operator places shield 20 on the writing surface as shown in FIG. 2, slide shield 20 over the surface in the normal writing movements. When one page or other inscription element is completed, the shield can be lifted by the little and adjacent fingers of the writing hand and placed upon the surface of next page. Upon completion of writing, the operator again sets shield 20 down and replaces pen 1 in pillar 22. If made of autoclavable material pen shield 10 and hand shield 20 may be sterilized as necessary. However, advantageously, the shields of this invention lend themselves to inexpensive manufacture from plastic, as by vacuum or extrusion molding, so in the preferred mode they are a single use item, discarded after they have become soiled or contaminated.

I claim:

1. A hand shield comprising:

i. a thin and flexible plate having generally flat upper and lower surfaces, a thickness of less than one quarter of an inch and a curved periphery, the plate to be placed in a cover position on a writing surface underlying the butt of the hand holding a pen in the writing position thereon with the thumb and forefinger extended to grasp a writing instrument and being of a size and shape to generally cover the writing surface underlying the butt of the hand held thereagainst when the cover position and to extend in the direction of projection of the thumb holding the pen to a forward terminal margin short of the tips of the thumb and forefinger, and ii. a pillar at a position above the upper surface of the plate where it is capable of being grasped by the small and/or adjacent finger of the hand held in the writing position with the plate in the cover position with the butt of the hand resting on the plate, to thereby hold the hand shield in the cover position during writing, the pillar being attached to the upper side of the plate and extending upwardly therefrom a sufficient distance for the pillar to be grasped and held by the smallest and adjacent finger while in the writing position with the thumb projecting forward to hold the pen but terminating at a height above the plate that is at or below the location of the palm when the hand is in the writing position overlying the plate with the butt of the hand resting thereagainst, the width of the pillar transverse to the thumb projection direction being sufficiently narrow so that the pillar may be grasped and held in the crooks of the fourth and smallest fingers.

2. A hand shield as in claim 1 and wherein the plate is made of transparent plastic.

3. A hand shield as in claim 1 and wherein the plate has a thickness of 1 millimeter or less.

4. A hand shield as in claim 1 and wherein the pillar terminates at a height of 2 inches or less above the side of the plate.

5. A hand shield as in claim 4 and wherein the pillar is from ¾ to 1 and ½ inches wide in the direction of thumb projection, from ¼ and ¾ inch wide in the direction transverse to the direction of thumb projection and is generally tapered in the thumb direction.

6. A hand shield as in claim 4 and wherein the plate extends forward of the pillar in the direction of thumb projection a distance of at least ¾ of an inch but less than 2 inches.

7. A hand shield as in claim 6 and wherein the plate extends rearward of the pillar in the direction opposed to the direction of thumb projection a distance of between about 2 to 4 inches.

8. A hand shield as in claim 7 and wherein, transverse to the direction of thumb projection, the plate extends from the pillar a distance of between about 2 and 4 inches in the direction faced by the palm when the hand is in the writing position on the plate and between about 1 and 2 inches in the direction opposed to the palm.

9. A hand shield as in claim 1 and wherein the pillar has a receptacle for receiving and holding the writing end of an elongated writing instrument.

10. A hand shield as in claim 1 and wherein the pillar has a margin facing and canted from the perpendicular to the plate in the direction of thumb projection at an angle of from about 5 to 45 degrees.

11. A hand shield as in claim 10 and wherein the pillar has a margin facing and canted from the perpendicular to the plate in the direction the thumb and forefinger project at an angle of from about 10 to 40 degrees and has a longitudinal axis in a plane parallel with the plate extending in the direction of thumb projection.

12. A hand shield as in claim 1 and including means for removably attaching the pillar to either side of the plate so that the shield to accommodate use thereof in either the left or right hand.

13. A hand shield as in claim 1 and wherein the pillar has a forward margin in the direction of the forward terminal margin of the plate that is generally transverse to the thumb projection direction and sides between the plate and the upper terminus of the pillar that extend generally parallel to the thumb projection direction to the forward margin of the pillar to facilitate orientation and holding of the handshield with the forward terminal margin of the plate in the thumb projection direction when the pillar is grasped by the smallest and adjacent fingers.

14. A hand shield as in claim 1 and wherein the width of the pillar in the direction transverse to the thumb projection is one inch or less.

15. A hand shield as in claim 1 and including receptacle means located above the plate for receiving therein downwardly toward the plate the writing end of a writing instrument and for holding the pen above the plate free for removal by lifting the pen upwardly therefrom.

16. A hand shield comprising:

i. a thin and flexible plate having generally flat upper and lower surfaces, a thickness of less than one quarter of an inch and a curved periphery, the plate to be placed in a cover position on a writing surface underlying the butt of the hand holding a pen in the writing position thereon with the thumb and forefinger extended to grasp a writing instrument and being of a size and shape to generally cover the writing surface underlying the butt of the hand held thereagainst when in the cover position and to extend in the direction of projection of the thumb holding the pen to a forward terminal margin short of the tips of the thumb and forefinger, and ii. a pillar at a position above the upper surface of the plate where it is capable of being grasped by the small and/or adjacent finger of the hand held in the writing position with the plate in the cover position with butt of the hand resting on the plate, to thereby hold the hand shield in the cover position during writing, the pillar being attached to the upper side of the plate and extending upwardly therefrom a sufficient distance for the pillar to be grasped and held by the smallest and adjacent finger while in the writing position with the thumb projecting forward to hold the pen but terminating at a height above the plate that is at or below the location of the palm when the hand is in the writing position overlying the plate with the butt of the hand resting thereagainst, the pillar having a forward margin in the direction of the forward terminal margin of the plate that is generally transverse to the thumb projection direction and sides between the plate and the upper terminus of the pillar that extend generally in the thumb projection direction to the forward margin of the pillar to facilitate orientation and holding of the handshield with the forward terminal margin of the plate in the thumb direction when the pillar is grasped by the smallest and adjacent fingers.

17. A hand shield as in claim 16 and wherein the pillar is generally of rectilinear configuration in the plane parallel with the plate.

18. A hand shield comprising:

i. a thin and flexible plate having generally flat upper and lower surfaces, a thickness of less than one quarter of an inch and a curved periphery, the plate to be placed in a cover position on a writing surface underlying the butt of the hand holding a pen in the writing position thereon with the thumb and forefinger extended to grasp a writing instrument and being of a size and shape to generally cover the writing surface underlying the butt of the hand held thereagainst when in the cover position and to extend in the direction of projection of the thumb holding the pen to a terminal margin short of the tips of the thumb and forefinger, ii. holding means at a position above the upper surface of the plate where it is capable of being grasped by the small and/or adjacent finger of the hand held in the writing position with the plate in the cover position with the butt of the hand resting on the plate, to thereby hold the hand shield in the cover position during writing, and iii. receptacle means located above the plate for receiving therein downwardly toward the plate the writing end of a writing instrument and for holding the pen above the plate free for removal by lifting the pen upwardly therefrom.

19. A hand shield as in claim 18 and wherein said receptacle means comprises a cavity in the holding means.

* * * * *